US005920954A

United States Patent [19]

Sepponen

[11] Patent Number: 5,920,954

[45] Date of Patent: Jul. 13, 1999

[54] DEVICE FOR CLEANING

[75] Inventor: Raimo Sepponen, Helsinki, Finland

[73] Assignee: Increa Oy, Helsinki, Finland

[21] Appl. No.: 08/894,209

[22] PCT Filed: Jan. 15, 1996

[86] PCT No.: PCT/FI96/00030

§ 371 Date: Jul. 30, 1997

§ 102(e) Date: Jul. 30, 1997

[87] PCT Pub. No.: WO96/23440

PCT Pub. Date: Aug. 8, 1996

[30] Foreign Application Priority Data

Jan. 30, 1995 [FI] Finland ..... 950388

[51] Int. Cl.[6] ..... A47L 5/00

[52] U.S. Cl. ..... 15/339; 15/347

[58] Field of Search ..... 15/339, 347

[56] References Cited

U.S. PATENT DOCUMENTS 4,751,759 6/1988 Zoell .

5,143,524 9/1992 Inculet et al. ..... 55/2

5,268,009 12/1993 Thompson et al. .

5,690,713 11/1997 Bowerman et al. ..... 55/490

FOREIGN PATENT DOCUMENTS

3820931 A1 of 0000 Denmark .

0 279 109 8/1988 European Pat. Off. .

0 600 101 A1 6/1994 European Pat. Off. .

2 490 110 of 0000 France .

*Primary Examiner*—David A. Redding

*Attorney, Agent, or Firm*—Reising, Ethington, Barnes, Kisselle, et al.

[57] ABSTRACT

A vacuum cleaner has a nozzle (N) connected to suction tubing (T) which passes air flow produced by suction from a central unit with a motor pump (M) that sucks air through the nozzle (N) and tubing (T). A portion of the air flow comes from ambient atmosphere (A) through a separate aperature (W) and passes by an ionization electrode (IP) and is directed onto the surface to be cleaned (SC) where dust particles have their electrical charge neutralized by the ionized air flow.

22 Claims, 3 Drawing Sheets

DEVICE FOR CLEANING

TECHNICAL FIELD

The invention relates to a device which can be used for cleaning, especially to remove dust. A typical application of this invention for cleaning is a vacuum cleaner.

BACKGROUND OF THE DISCLOSURE

A vacuum cleaner is frequently used to remove dust. The main parts of a vacuum cleaner and its functions are as follows: a flow of air is produced through the vacuum cleaner, and this flow of air is sucked into a dust bag and suction tubing and also through a nozzle and blown out through an exhaust duct that may have one or more filters for the exhaust air.

It is easy to remove impurities of relatively great size with a vacuum cleaner, but small sized dust particles firstly stick to the surface to be cleaned because of the static electricity and secondly penetrate the filters for the exhaust air.

The present invention addresses the weaknesses of the present technology and provides for overcoming the static electric charges of the small sized dust particles.

The invention can be realized as e.g. a vacuum cleaner, which carefully removes small dust particles and effectively prevents them from escaping from the exhaust air back into the room.

BRIEF DESCRIPTION OF THE DRAWINGS

The invention is shown in the enclosed drawings, where.

DETAILED DESCRIPTION OF THE PREFERRED EMBODIMENT

Figure 1:
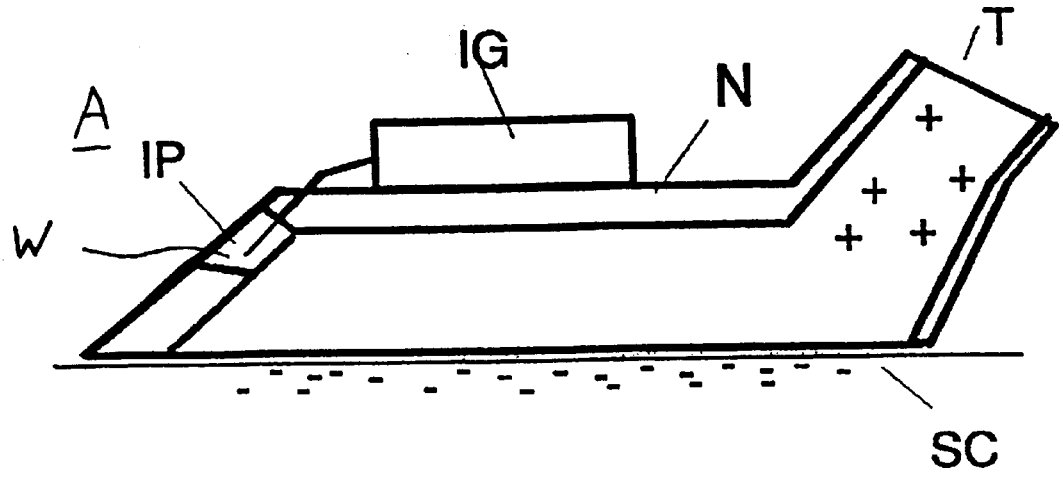
FIG. 1 shows the invented nozzle used as a conventional nozzle

FIG. 1 shows a nozzle (N), e.g. part of a vacuum cleaner. Nozzles of various shapes and sizes are conventional equipment for a vacuum cleaner. The suction tubing (T) of a vacuum cleaner is joined to the nozzle (N) during operation, and air is sucked through the nozzle to clean a surface (SC). Generally T consists of a flexible and a rigid tube part, which can be of telescopic construction. The nozzle (N) directs the air flow from the SC. IG is a device for ionization which generates a high voltage in the ionization electrode (IP) while in use. In FIG. 1 is shown a situation, when IP is not used. This situation corresponds to the use of a nozzle according to known technology. When the air flow goes under the nozzle it ionizes the surface SC and the itself. This mechanism is due to the differences in the dielectric constants in the surface and the air. In practice wood, plastic and cloth are charged negatively, while air positively As dust and surface (SC) are of different material or mixed with air to various degrees, they are charged with charges of different size and the dust will therefore stick tightly to the surface (SC) because of the effect of static electricity. This has been proved in practice: it is extremely difficult to remove fine dust from surfaces with a vacuum cleaner, it needs wiping with a dampened cloth or similar material.

Figure 2:
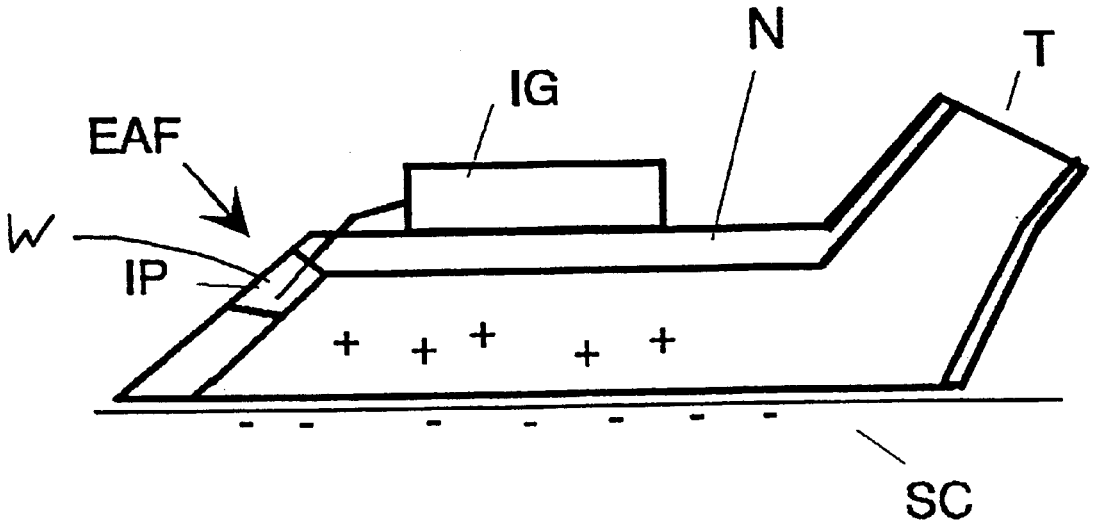
FIG. 2 shows the invented nozzle used in accordance with the invention

FIG. 2 shows the use of a nozzle in accordance with the invention. The ionization device (IG) while in operation and the high voltage it produces will ionize the air with electrodes IP. The ionization of the nozzle occurs in the air flow EAF, which is arranged to occur through a special aperture W of the nozzle from ambient atmosphere. Through the effect of the ionization the charges occurring on the surface (SC) are neutralized, and the fine dust is easily carried with the air flow to the tube of the vacuum cleaner. The nozzle can the replaced, just as in known vacuum cleaners. It has been thought that the design of the nozzles could improve the practicability of the device for various spots to be cleaned.

Figure 3:
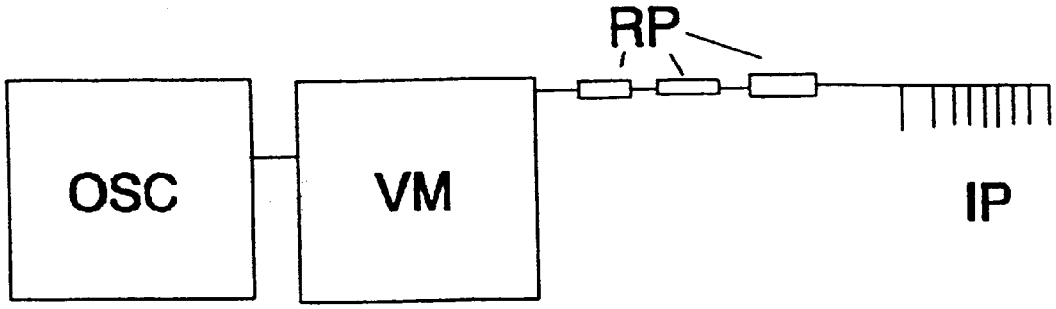
FIG. 3 shows a block diagram of the ionization generator in the invented device

FIG. 3 shows a block diagram of the ionization device (IG): oscillator (OSC) produces an alternative current, which together with the voltage multiplier (VM) generates a voltage of numerous kilovolts. This voltage in turn is conducted through the safety resistors (RP) to the ionization electrode (IP). Resistors (RP) are used to ensure the safety of the user.

Figure 4:
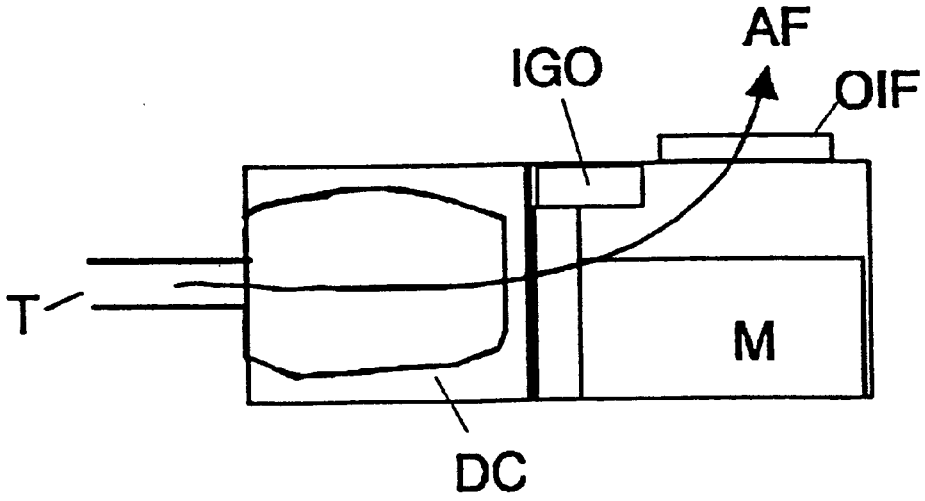
FIG. 4 shows one construction of the central unit of a vacuum cleaner in accordance with the invention

FIG. 4 shows one construction of the central unit of a vacuum cleaner in accordance with the invention. The equipment of the motor pump (M) sucks air through the tubing (T) and dust bag (DC) and blows the air (AF) through a second ionization device (IGO) for the exhaust air filters (OIF) into the room. The central unit of a so-called central vacuum cleaner is similar, but the second ionization device IGO and the exhaust air filter OIF can be left out if the exhaust air need not be cleaned thoroughly.

The ionization device IG charges positively, and the exhaust air filter OIF is a Filter which has a conducting surface connected to negative voltage. It is a known fact that air saturated with negative ions is healthy, therefore the second ionization device IGO should be equipped to, ionize the AF negatively just before the exhaust air leaves the vacuum cleaner. Electrostatic filtering ensures the purity of the exhaust air. Ol is a ionization electrode, which is connected with the ionization device IGO. When the AF goes through the Ol it will become ionized with negative ions.

Figure 5:
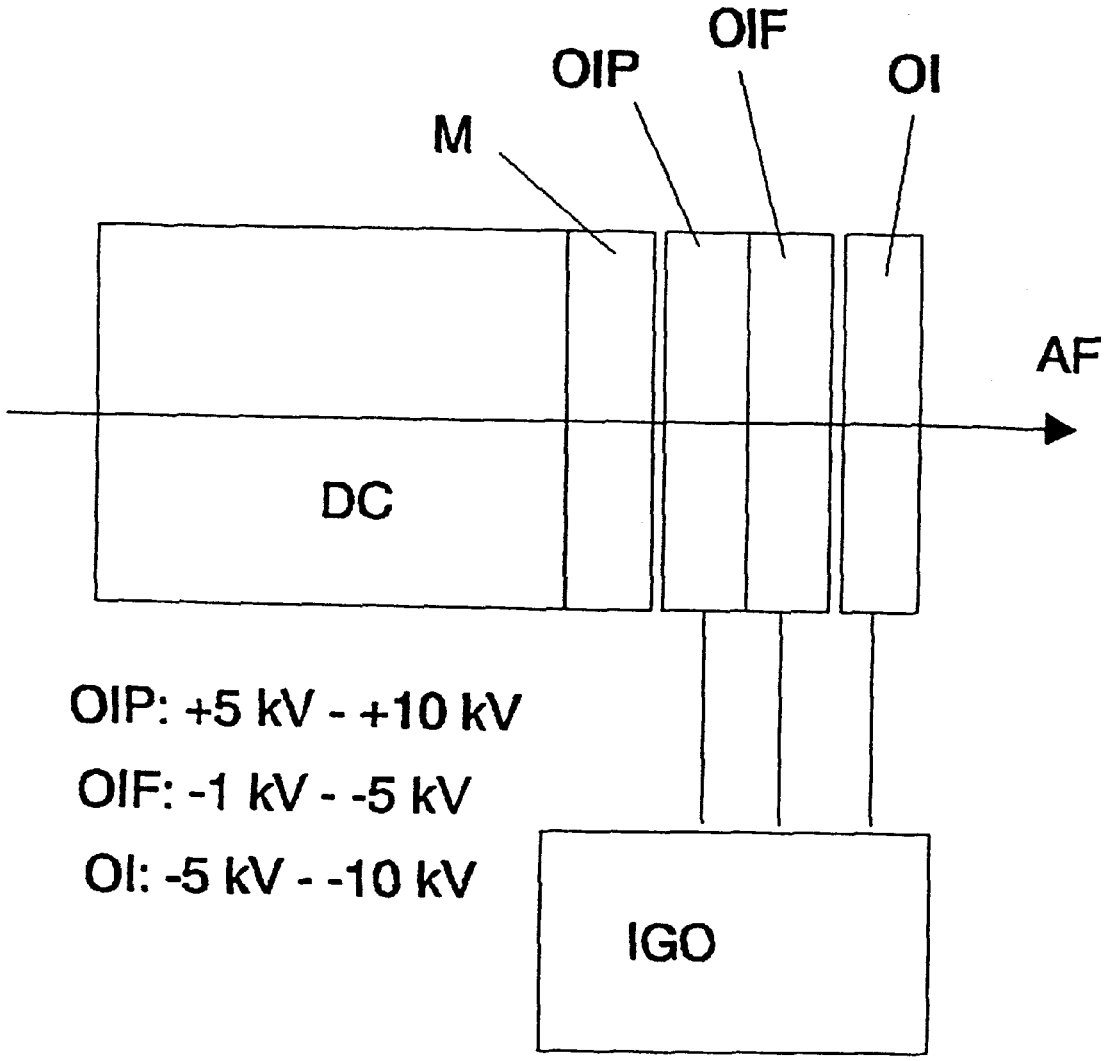
FIG. 5 shows an outline of the air flow through the air blower, the dust bag and through the filters and means of ionization.

The air flow (AF) progress through the various filters and means of ionization is shown in FIG. 5. The figure also illustrates the connection of the high voltage source of the ionizer to different filters, ionization device and voltages.

OIF can include a filter unit produced from thin metal foil, which is produced from scrap metal. As filter material can also be used, e.g. paper containing carbon fibres, plastic with a conducting coating, etc. The filter can be a cassette having a frame and a filter part. The foil in the filter part can be fibrous and loosely packed, to let the air flow fairly smoothly penetrate after contacting a great area. Then the filter is easy and cheap to manufacture and it could be made disposable.

The Filter could also be recycled, because it is easy to remove the dust attached.

Above illustrates as typical for the invention that it contains the means IG, IP, which are placed to ionize the air before it gets into contact with surface SC and then neutralizes the static electricity charge which otherwise would have occurred. The ionization can be either positive or negative, or both. A separate route could be arranged for the air to be ionized before it contacts the surface SC.

Furthermore, the device invented can include the second ionization IGO intended for cleaning the exhaust air The IGO ionizes the exhaust air filters OIF opposite the filter surfaces.

Furthermore, the device invented may include the additional device IGO, which also ionize the exhaust air AF negatively just before the air leaves the means OIF, for example into the room.

Furthermore, the means OIF may include a filter unit, which is meant to be disposable. Advantageous is to use thin metal foil made from scrap metal, and the filter unit can be recycled again.

Above is illustrated how the invention can be used in one way. The invention is not restricted to the above, but is can be utilized in many other accomplishments within the limits of the invention defined by in the enclosed patent claims.

I claim:

1. A vacuum cleaning device with a flow of air which is to be sucked by the device, including a central unit having a motor pump that causes suction of air flow, a nozzle and a suction tubing characterized in that it includes an ionization device, at least part of the flow of air for cleaning and which is generated by suction from said motor pump through said tubing is to be ionized with said ionization device and said part of the flow of air is to be sucked through the range of influence of said ionization device before said flow of air is to be contacted with the surface to be cleaned.

2. A cleaning device as set forth in claim 1 characterized in that at least a part of said ionization device is placed in the nozzle.

3. A cleaning device as set forth in claim 2, further characterized in that the nozzle may be disconnected from the suction tubing.

4. A cleaning device as set forth in claim 3 further characterized in that it includes another ionization device for ionization of air to be exhausted.

5. A cleaning device as set forth in claim 4 further characterized in that it includes a filter for electrostatic filtering of air to be exhausted.

6. A cleaning device as set forth in claim 5 further characterized in that said additional ionization device for ionization of air to be exhausted provides negative ions.

7. A cleaning device as set forth in claim 6 further characterized in that said filter includes a replaceable filtering component.

8. A cleaning device as set forth in claim 1, further characterized in that the nozzle may be disconnected from the suction tubing.

9. A cleaning device as set forth in claim 2 further characterized in that it includes another ionization device for ionization of air to be exhausted.

10. A cleaning device as set forth in claim 9 further characterized in that it includes a filter for electrostatic filtering of air to be exhausted.

11. A cleaning device as set forth in claim 10 further characterized in that said additional ionization device for ionization of air to be exhausted provides negative ions.

12. A cleaning device as set forth in claim 11 further characterized in that said filter includes a replaceable filtering component.

13. A cleaning device as set forth in claim 1 further characterized in that it includes another ionization device for ionization of air to be exhausted.

14. A cleaning device as set forth in claim 13 further characterized in that it includes a filter for electrostatic filtering of air to be exhausted.

15. A cleaning device as set forth in claim 14 further characterized in that said additional ionization device for ionization of air to be exhausted provides negative ions.

16. A cleaning device as set forth in claims 15 further characterized in that said filter includes a replaceable filtering component.

17. A cleaning device as set forth in claim 1 further characterized in that it includes an additional ionization device for ionization of air to be exhausted with negative ions.

18. A cleaning device as set forth in claim 14 further characterized in that said filter includes a replaceable filtering component.

19. A cleaning device as set forth in claim 13 further characterized in that said filter includes a replaceable filtering component.

20. A cleaning device as set forth in claim 1 further characterized by:

said at least part of the flow of air being ionized as it is sucked into said nozzle from ambient atmospheres through a separate aperture in said nozzle.

21. A cleaning device as set forth in claim 20 further characterized by:

said ionization device includes an ionization electrode mounted at said separate aperture in said nozzle.

22. A cleaning device as set forth in claim 21 further characterized by:

said aperture inclined to direct said at least part of the air flow downwardly to contact the surface to be cleaned.

* * * * *